US006919806B2

(12) United States Patent
Narlow et al.

(10) Patent No.: US 6,919,806 B2
(45) Date of Patent: Jul. 19, 2005

(54) DEACTIVATABLE RADIO FREQUENCY SECURITY LABEL

(75) Inventors: Douglas Narlow, Coral Springs, FL (US); Hubert A. Patterson, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 54 days.

(21) Appl. No.: 10/236,809

(22) Filed: Sep. 6, 2002

(65) Prior Publication Data

US 2004/0046665 A1 Mar. 11, 2004

(51) Int. Cl.[7] ..... G08B 13/14

(52) U.S. Cl. ..... 340/572.1; 340/572.2; 340/572.3; 343/741

(58) Field of Search ..... 340/572.4, 572.7, 340/551, 556, 572.1, 572.3, 572.2, 572.5, 572.8; 343/741, 742, 748

(56) References Cited

U.S. PATENT DOCUMENTS 4,567,473 A 1/1986 Lichtblau
4,682,154 A * 7/1987 Fearon et al. ..... 340/572.3
4,802,944 A 2/1989 Benge ..... 156/247
5,059,950 A 10/1991 Perchak ..... 340/572
5,754,110 A 5/1998 Appalucci et al. ..... 340/572
5,841,350 A 11/1998 Appalucci et al. ..... 340/572
6,091,607 A * 7/2000 McKeown et al. ..... 340/572.3
6,400,271 B1 * 6/2002 Davies et al. ..... 340/572.1
6,480,110 B2 * 11/2002 Lee et al. ..... 340/572.5
6,549,132 B2 * 4/2003 Parrotta et al. ..... 340/572.1

* cited by examiner

*Primary Examiner*—Davetta W. Goins

(57) ABSTRACT

A deactivation apparatus for an electronic article surveillance tag having a plurality of layers and an equivalent resonant circuit containing an inductor and a capacitor is provided. The apparatus includes: a capacitor formed by a pair of conductive capacitor plates separated apart by a dielectric layer; an inductor connected to each of the pair of capacitor plates where an electromagnetic field of a preselected frequency at a first magnitude impinging upon the tag causes the equivalent resonant circuit to resonate and produce a detectable response from the tag; and, an electrically weakened area in the dielectric layer between the pair of conductive capacitor plates where the electromagnetic field at a second magnitude higher than the first magnitude impinging upon the tag causes a conductive path through the weakened area electrically connecting the pair of capacitor plates together and deactivating the tag.

8 Claims, 3 Drawing Sheets

DEACTIVATABLE RADIO FREQUENCY SECURITY LABEL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to radio frequency (RF) security labels having a deactivatable resonant circuit.

2. Description of the Related Art

Electronic article surveillance (EAS) systems are widely used in commercial and retail establishments to deter theft or other unauthorized removal of articles from the surveillance area. In one commonly used EAS system, each article or item to be protected carries a security tag or label, which may be affixed on or inside packaging or as a label for the article or item, or on or inside the article or item itself, containing an electronic circuit, such as an inductor/capacitor resonant circuit. The resonant tag circuit is detected or identified by equipment for establishing an RF electromagnetic field in a surveillance zone at the exit of the surveillance area.

The detectable resonant circuit of the EAS tag is a small, generally planar, multi-layer structure having a dielectric substrate and conductive layers on opposite sides of the substrate that define an inductor and at least one capacitor that provide a circuit resonant at at least one predetermined detection frequency.

Removal of a tagged article from the surveillance area is typically authorized at a checkout counter, where the clerk deactivates the tag. The security tag may be deactivated by changing the resonant frequency of the tag so that the tag resonates outside of the predetermined detection frequency or by altering the resonant circuit so that the circuit no longer resonates.

A typical deactivation technique is accomplished electronically, by passing the tag through a deactivating RF field that disables the detectable resonant circuit. Such deactivation involves exposing the resonant tag circuit to an RF field having a predetermined minimum energy level sufficient to cause either short-circuiting of the resonant circuit or creation of an open circuit and thereby preventing the circuit from resonating at the predetermined detection frequency.

In a typical implementation of deactivation a portion of one conductor in a multi-layer resonant tag circuit is indented or "dimpled". Deactivation is accomplished by exposure of the tag to a specific RF field at a predetermined energy level that causes a short circuit at the indent or dimple, which results in the desired deactivation of the resonant circuit being targeted. Examples of "dimpled" deactivation tag devices are shown in U.S. Pat. Nos. 4,567,473 and 5,841,350. Other deactivation techniques include the use of fuseable links as shown in U.S. Pat. Nos. 4,802,944 and 5,059,950.

BRIEF SUMMARY OF THE INVENTION

The present invention is a deactivation apparatus for an electronic article surveillance tag having a plurality of layers and an equivalent resonant circuit containing an inductor and a capacitor. The apparatus includes: a capacitor formed by a pair of conductive capacitor plates separated apart by a dielectric layer; an inductor connected to each of the pair of capacitor plates where an electromagnetic field of a preselected frequency at a first magnitude impinging upon the tag causes the equivalent resonant circuit to resonate and produce a detectable response from the tag; and, an electrically weakened area in the dielectric layer between the pair of conductive capacitor plates where the electromagnetic field at a second magnitude higher than the first magnitude impinging upon the tag causes a conductive path through the weakened area electrically connecting the pair of capacitor plates together and deactivating the tag.

The electrically weakened area can be a mixture of a conductive material and a nonconductive binder disposed in a void area of the dielectric layer between the pair of capacitor plates.

The electrically weakened area can alternately include an oxide layer between each of the pair of capacitor plates and the dielectric layer, and a conductive material disposed in a void area of the dielectric material between the pair of capacitor plates.

Objectives, advantages, and applications of the present invention will be made apparent by the following detailed description of embodiments of the invention.

DETAILED DESCRIPTION OF THE INVENTION

Figure 1:
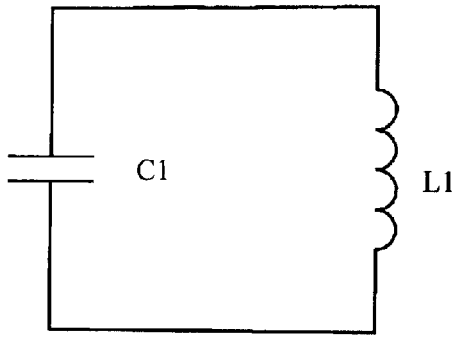
FIG. 1 is a schematic diagram of the resonant circuit used in the present invention.

Referring to FIG. 1, the basic resonant circuit associated with the present invention includes capacitor C1 and inductor L1. A conductor coil on one or more layers of a multi-layered EAS label typically forms inductor L1. Two conductive plates separated by a dielectric material form capacitor C1.

Figure 2:
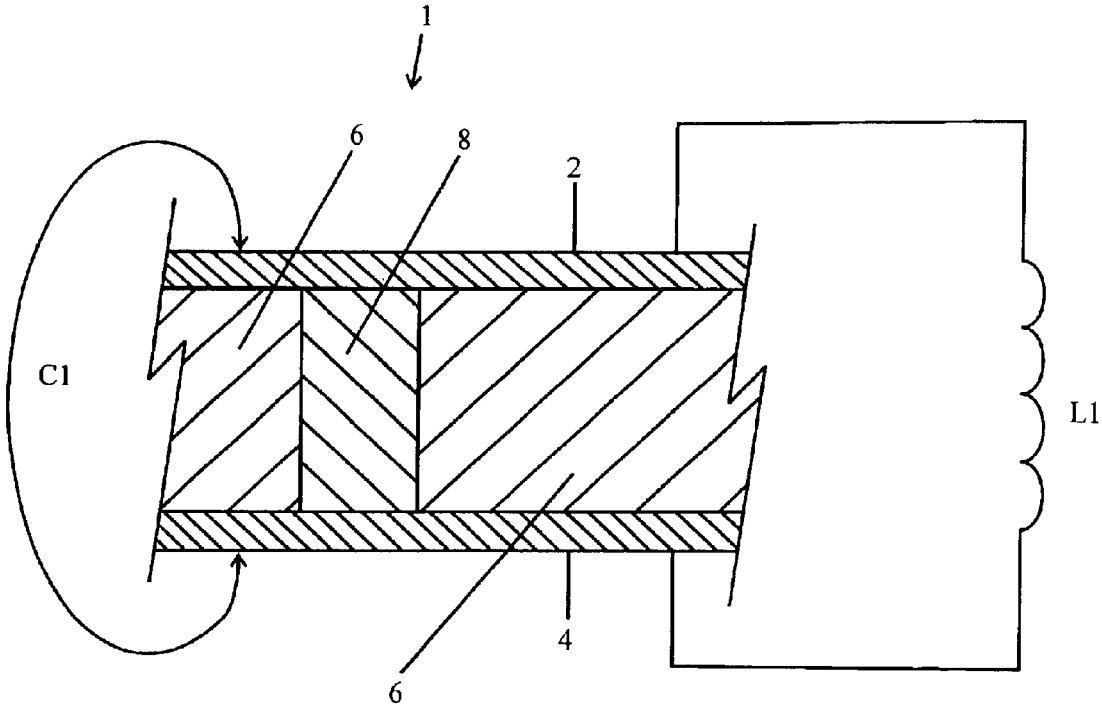
FIG. 2 is a schematic diagram of one embodiment of the present invention.

Referring to FIG. 2, inductor L1 is connected to conductive capacitor plates 2 and 4 as shown in the illustration of the relevant portions of an RF EAS tag 1, according to one embodiment of the present invention. Capacitor plates 2 and 4 of capacitor C1 are separated by dielectric material 6. Dielectric material 6 can be an adhesive layer that retains plates 2 and 4 in their desired position. Inlaid in a cutout or void area of dielectric material 6 is a matrix made of a conductive material in a nonconductive binder 8. The conductive material can be any suitable conductive material that is adapted to be mixed with a binder, and can include, but is not limited to, a metal such as copper, aluminum, bronze, and the like, or a conductive material such as carbon. The nonconductive binder can be made of, but is not limited to, varnish, polymers, polyurethane, and other nonconductive materials, the selection of which is well known in the art. Upon exposure to an electromagnetic field of sufficient magnitude and at the appropriate frequency and duration, the matrix of conductive material and nonconductive binder 8 forms a carbonized or conductive path between capacitor plates 2 and 4. The carbonized path shorts plates 2 and 4 of capacitor C1 rendering the EAS tag 1 non-resonant at its operating frequency, or deactivated. The field level required to resonate tag 1 for normal operation is lower than the magnitude required to short capacitor C1. Normal operation means that when tag 1 resonates it produces a signal detectable by an electronic article surveillance receiver (not shown). Deactivation occurs only when tag 1 is radiated with a field level of sufficient magnitude required for deactivation, which shorts plates 2 and 4.

Figure 3:
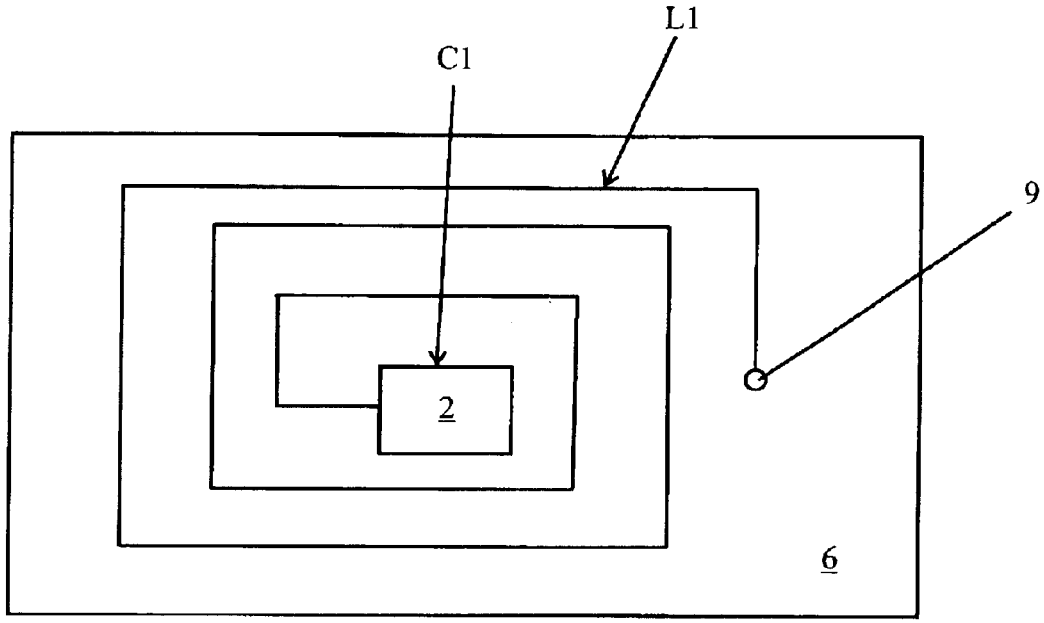
FIG. 3 is a top plan view of one embodiment of the present invention.

Referring to FIG. 3, a top plan view of one embodiment of the present invention shows inductor L1 may be formed by a coil of copper or other suitable conductor material on adhesive dielectric material 6, which also carries conductor plate 2 of capacitor C1. Additional layers may be present, but are not shown. Inductor L1 is connected to through contact 9.

Figure 4:
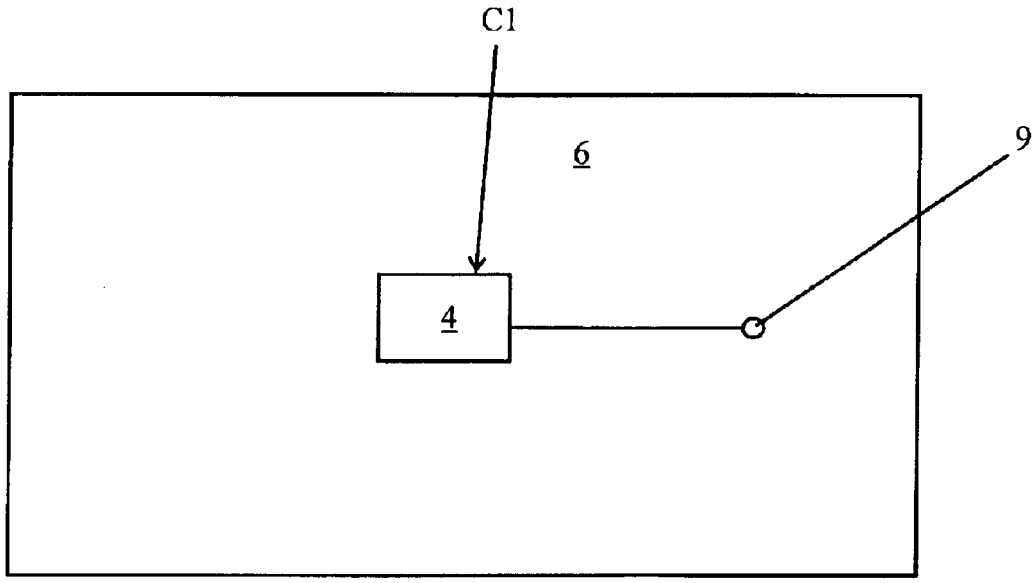
FIG. 4 is a bottom plan view of that shown in FIG. 3.

Referring to FIG. 4, a bottom plan view of the embodiment illustrated in FIG. 3 shows through contact 9 in electrical connection with conductor plate 4 of capacitor C1. The electrical circuit is thus completed as illustrated in FIG. 1. As stated, additional layers may be present, as well as other physical implementations of coil L1 and capacitor plates 2 and 4.

Figure 5:
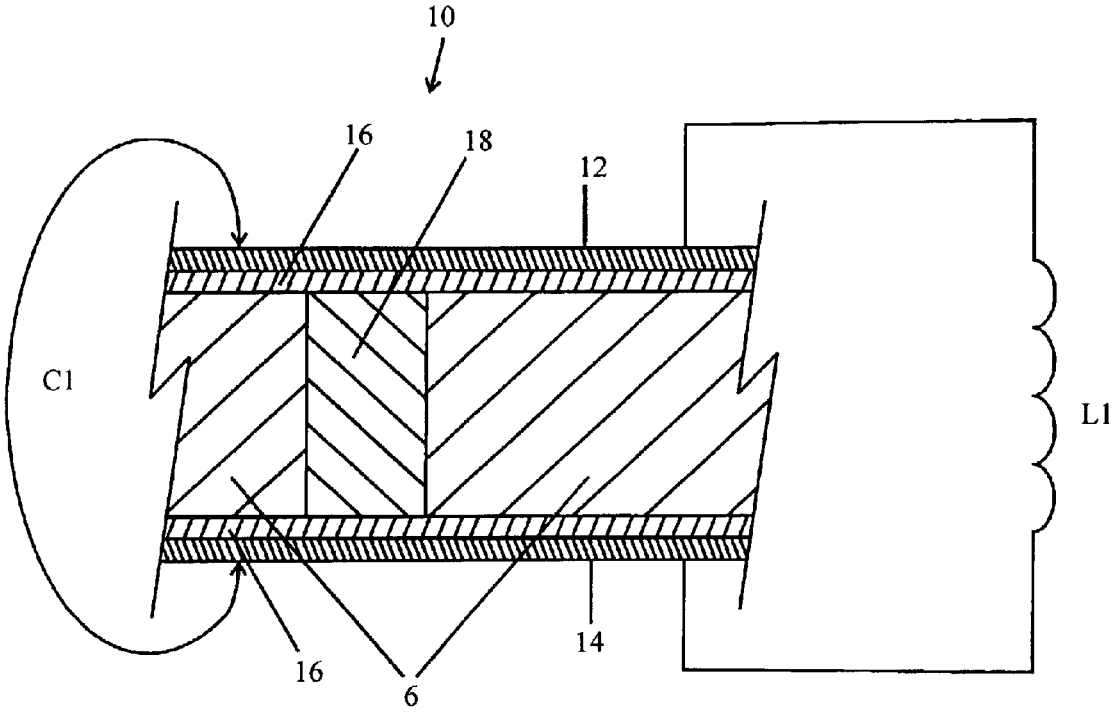
FIG. 5 is a schematic diagram of an alternate embodiment of the present invention.

Referring to FIG. 5, the relevant portions of an alternate embodiment of RF EAS tag 10 is illustrated. In tag 10, conductive capacitor plates 12 and 14 are both separated from dielectric material 6 by an oxide layer 16. A conductive material 18, which can be a conductive material as described hereinabove or another conductive material, is inlaid in an opening or void area in dielectric material 6. Exposing tag 1 to an electromagnetic field of sufficient magnitude, frequency, and duration causes a carbonizing path through oxide layer 16 between the conductive plates 12 and 14 and conductive material 18. The resulting short circuit of capacitor C1 renders tag 10 non-resonating at the intended operating frequency, and deactivates tag 10.

In the present invention, one resonant frequency selection is about 8 MHz, but the invention is not so limited and can be used at other frequencies. The desired deactivation electromagnetic field can be a similar RF field but of relatively high magnitude, and can be an RF pulse. The invention can be implemented at other frequencies as long as a suitable shorting deactivation mechanism can be implemented by an electrically weakened area as disclosed herein.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. In a deactivation system for an electronic article surveillance tag having a plurality of layers and an equivalent resonant circuit containing an inductor and a capacitor, the apparatus comprising:

a capacitor formed by a pair of conductive capacitor plates separated apart by a dielectric layer between said capacitors plates, said dielectric layer having at least one electrically weakened area as a characteristic of one or more materials forming at least a portion of said dielectric layer;

an inductor connected to each of said pair of capacitor plates wherein an electromagnetic field of a pre-selected frequency at a first magnitude impinging upon the tag causes the equivalent resonant circuit to resonate and produce a detectable response from the tag; and, wherein said electromagnetic field at a second magnitude higher than said first magnitude impinging upon the tag causes a conductive path through said electrically weakened area electrically connecting said pair of capacitor plates together.

2. The apparatus of claim 1, wherein said electrically weakened area comprises a mixture of conductive material and a nonconductive binder disposed in a void area of said dielectric layer between said pair of capacitor plates.

3. The apparatus of claim 1, wherein said electrically weakened area comprises an oxide layer between each of said pair of capacitor plates and said dielectric layer, and a conductive material disposed in a void area of said dielectric material between said pair of capacitor plates and said oxide layers.

4. An electronic article surveillance device comprising:

a capacitor formed by a pair of conductive capacitor plates separated apart at a substantially uniform distance by a dielectric layer between said capacitors plates, at least one electrically weakened area within said dielectric layer wherein said electromagnetic field at a second magnitude higher than said first magnitude impinging upon the tag causes a conductive path through said electrically weakened area electrically connecting said pair of capacitor plates together; and an inductor connected to each of said pair of capacitor plates wherein an electromagnetic field of a pre-selected frequency at a first magnitude impinging upon the tag causes the equivalent resonant circuit to resonate and produce a detectable response from the tag.

5. The apparatus of claim 4, wherein said electrically weakened area comprises a mixture of conductive material and a nonconductive binder disposed in a void area of said dielectric layer between said pair of capacitor plates.

6. The apparatus of claim 4, wherein said electrically weakened area comprises an oxide layer between each of said pair of capacitor plates and said dielectric layer, and a conductive material disposed in a void area of said dielectric material between said pair of capacitor plates and said oxide layers.

7. In an electronic article surveillance tag having a capacitor formed by at least one pair of conductive capacitor plates and an inductor connected to each of said pair of capacitor plates, wherein an electromagnetic field of a pre-selected frequency at a first magnitude impinging upon the tag causes the equivalent resonant circuit to resonate and produce a detectable response from the tag, the apparatus comprising:

a dielectric layer between said capacitor plates, said dielectric layer having a mixture of conductive material and a nonconductive binder in at least a portion thereof forming at least one electrically weakened area, wherein said electromagnetic field at a second magnitude higher than said first magnitude impinging upon the tag causes a conductive path through said electrically weakened area electrically connecting said pair of capacitor plates together.

8. An electronic article surveillance device comprising:

a capacitor formed by at least one pair of conductive capacitor plates and a dielectric layer therebetween;

an inductor connected to each of said pair of capacitor plates, wherein an electromagnetic field of a preselected frequency at a first magnitude impinging upon the tag causes the equivalent resonant circuit to resonate and produce a detectable response from the tag;

at least one oxide layer portion between each of said pair of capacitor plates and said dielectric layer, and at least one conductive material disposed in a void area of said dielectric layer between said pair of capacitor plates and said oxide layer portions.

* * * * *